United States Patent [19]

Hagemeister

[11] Patent Number: 5,058,663

[45] Date of Patent: Oct. 22, 1991

[54] CURVED TUBES OF A HEAT EXCHANGER

[75] Inventor: Klaus Hagemeister, Munich, Fed. Rep. of Germany

[73] Assignee: MTU-Motoren-und Turbinen-Union Munchen GmbH, Munich, Fed. Rep. of Germany

[21] Appl. No.: 478,210

[22] Filed: Feb. 9, 1990

[30] Foreign Application Priority Data

Feb. 11, 1989 [DE] Fed. Rep. of Germany ..... 3904140

[51] Int. Cl.[5] ..... F28D 7/08

[52] U.S. Cl. ..... 165/162; 165/163

[58] Field of Search ..... 165/162, 163

[56] References Cited

U.S. PATENT DOCUMENTS

| | | | |
|---|---|---|---|
| 2,519,084 | 8/1950 | Tull | 165/163 |
| 3,042,379 | 7/1962 | Hinde | 165/162 |
| 3,212,570 | 10/1965 | Holman | 165/162 |
| 3,336,974 | 8/1967 | Bernstein et al. | 165/162 |
| 3,605,872 | 9/1971 | Brault | 165/163 |
| 3,848,430 | 11/1974 | Porter et al. | 165/162 |
| 3,989,105 | 11/1976 | Trepaud | 165/162 |
| 4,058,161 | 11/1977 | Trepaud | 165/162 |
| 4,105,067 | 8/1978 | Bovagne | 165/162 |
| 4,573,528 | 3/1986 | Trepaud | 165/162 |
| 4,577,684 | 3/1986 | Hagemeister | 165/162 |

FOREIGN PATENT DOCUMENTS

| | | | |
|---|---|---|---|
| 2535075 | 2/1977 | Fed. Rep. of Germany | 165/163 |
| 732163 | 9/1932 | France | 165/162 |
| 399709 | 2/1974 | U.S.S.R. | 165/163 |
| 394864 | 7/1933 | United Kingdom | 165/163 |

*Primary Examiner*—John Rivell
*Assistant Examiner*—L. R. Leo
*Attorney, Agent, or Firm*—Ladas & Parry

[57] ABSTRACT

A tube matrix for a heat exchanger is connected between two spaced ducts for conveying a fluid from one duct to the other. The tube matrix has a plurality of spaced heat exchange tubes whose ends are secured to the ducts and which have a generally S-shape between the ducts. At the points of lateral offset and at the intermediate point therebetween, spaces are provided for keeping adjacent tubes in spaced relation from one another. Each loop of the S-shape tube is formed with two successive sections each of which includes two segments of opposite curvature such that in all there are eight segments which make up the tube. Preferably, the tube is a one piece member and the shape is formed by bending the tube. At each of the points where the tubes are secured and are connected by the spacers, tangents to the tubes extend parallel to one another.

11 Claims, 1 Drawing Sheet

CURVED TUBES OF A HEAT EXCHANGER

FIELD OF THE INVENTION

The invention relates to the construction of tubes of a tube matrix for a heat exchanger in which the tube matrix is connected to two spaced ducts for conveying a fluid from one duct to the other. Each of the tubes is secured at its ends to the respective ducts and is curved to have a generally S-shape between the ducts. Spacers are provided between the tubes at suitable locations for keeping adjacent tubes spaced from one another.

DESCRIPTION OF PRIOR ART

A tube matrix of the above type is disclosed in DE-PS 35 43 893 and its U.S. equivalent Pat. No. 4,809,774. Therein is disclosed a number of S-shaped curved heat exchange tubes connected between a fluid conveying duct and a reversal section. By curving the individual tubes, a number of advantages are obtained compared to rectilinear tubes. This arrangement, however, has the disadvantage that expansion of each tube results in transverse displacement of the tube with respect to the rest of the tubes of the matrix at the peaks of the curves where the spacers are arranged. Hence, expansion compensation is limited to the play present in the spacers.

SUMMARY OF THE INVENTION

An object of the invention to provide a tube matrix of this type in which an unhindered expansion can be obtained under all operating conditions without shaping the heat exchanger system in an undesirable way.

In accordance with the invention, a tube matrix is formed with a plurality of spaced heat exchange tubes each of which has ends secured to spaced ducts of the heat exchanger and between the ducts each tube has a generally S-shape. Each tube has two peaks with points of maximum offset and an intermediate point between the peaks. At each of the points of maximum offset and at the intermediate point, there are spacer means for keeping adjacent tubes spaced from one another. Each tube includes respective contiguous sections between successive spacer means at said points and each section includes two segments of opposite curvature. The spacer means engages each tube at said points such that tangents to the tube at said points extend substantially parallel to one another.

The juxtaposed rows of curved tubes of the matrix according to the invention provide a complete undulating path over the entire length of a tube, which makes possible a controlled deformation of an entire tube or of an entire row of tubes of the matrix due to relative displacement caused by thermal expansion, or shock-produced expansions or deformation with respect to the external mounting. The deformation of the tubes may be controlled despite the provision of clamps attached at both ends and a rigid connection with spacer means so that the tube can be expanded and contracted in length with only small internal stresses due to temperature differences and gradients without basically changing the flow cross section between adjacent tubes. It must be emphasized that the tube is manufactured as an integral one piece member and that the individual curved segments represent bent sections of a portion of one tube.

As a consequence of the S-shaped curve of the tubes, the compensation for deformation in the plane through a tube row is taken up by bending of the curved segments between the spacer means whereby a low resistance to deformation is obtained along with low stresses as compared to rectilinear tubes.

A considerable advantage of the novel configuration of the tubes of the invention is that the spacer means may be fixed without play at the sites of maximum tube offset and at the intermediate points, whereby the tube matrix can be rigidly supported at these places to resist vibrations and impact forces. Compensation for change of length of the tube is thus obtained by compressing or expanding the tubes over the length of two curved segments which are contiguous, i.e., between two secured points, which occur at least twice along an entire tube section. Therefore transverse deflections are produced for the same relative change of length, and these deflections are smaller by approximately a factor of three than those of the known embodiments.

In a preferred embodiment of the invention, the curved segments have constant radii of curvature, whereby a simple manufacture of the curved segments can be achieved. It is advantageous if all curved segments have the same radius of curvature, which preferably is between approximately 1 and 2 times the length of the curved segments. In a tube, for example, which is made up of eight curved segments, the distances between adjacent tubes, for through-flow of an external heating fluid, can also be maintained sufficiently, even when there are large differences in temperature. The places of minimal spacing between two tubes occurs at the points of change of curvature i.e., at the points of inflection between two oppositely curved segments.

In an alternative configuration according to the invention, the curved segments have a sinusoidal shape. Two alternative embodiments are possible for such shape. According to a preferred embodiment the two curved segments together form a complete sine wave, i.e. 2 $\pi$. Thus, the points of inflection between two oppositely curved segments is at angle $\pi$.

According to an alternative embodiment, two curved segments can form a half sine wave. That is, the axis of the sine wave is equally spaced and parallel to the tangents at the tubes at the two attachment points. The two attachment points thus are at angles o and $\pi$.

Preferably, the tubes have an approximately elliptical cross section, and the individual curved segments are bent around the axis having the smaller moment of inertia. This is the major axis of the elliptical cross section. Such an elliptical cross section makes possible a more aerodynamically favorable flow of external heating gases between and around the tubes. It is also possible for the tubes to have a circular cross section to achieve simplified manufacture.

DETAILED DESCRIPTION OF PREFERRED EMBODIMENTS

Figure 2:
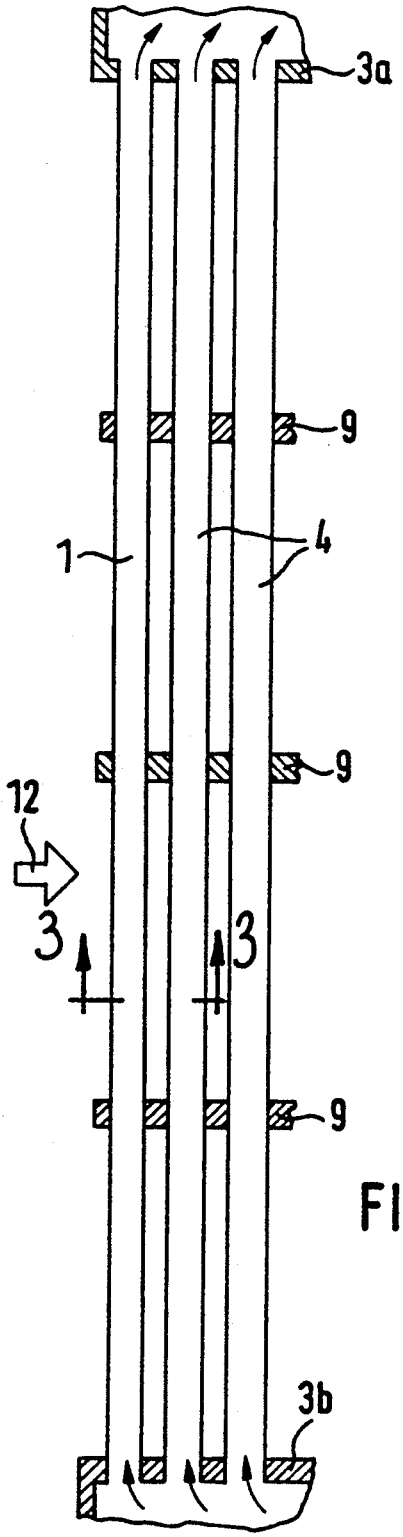
FIG. 2 is a top view of the heat exchanger in FIG. 1 showing three tubes of the tube matrix of the heat exchanger.

In the drawing there is diagrammatically illustrated an entire heat exchange tube 1 of a tube matrix of a heat exchanger. The matrix consists of a plurality of such tubes arranged in rows and columns in spaced relation. The tubes are secured at their ends at connection points *2a* and *2b* in ducts *3a* and *3b* which can convey fluid. The fluid flows from duct *3b* to duct *3a* as shown in FIG. 2. Ducts *3a* can be replaced by a reversal section so that fluid can flow from the duct *3b* through the tube matrix and the fluid is then reversed in the reversal section and flows back through other legs of the tubes of the tube matrix to a third duct of the heat exchanger.

Figure 1:
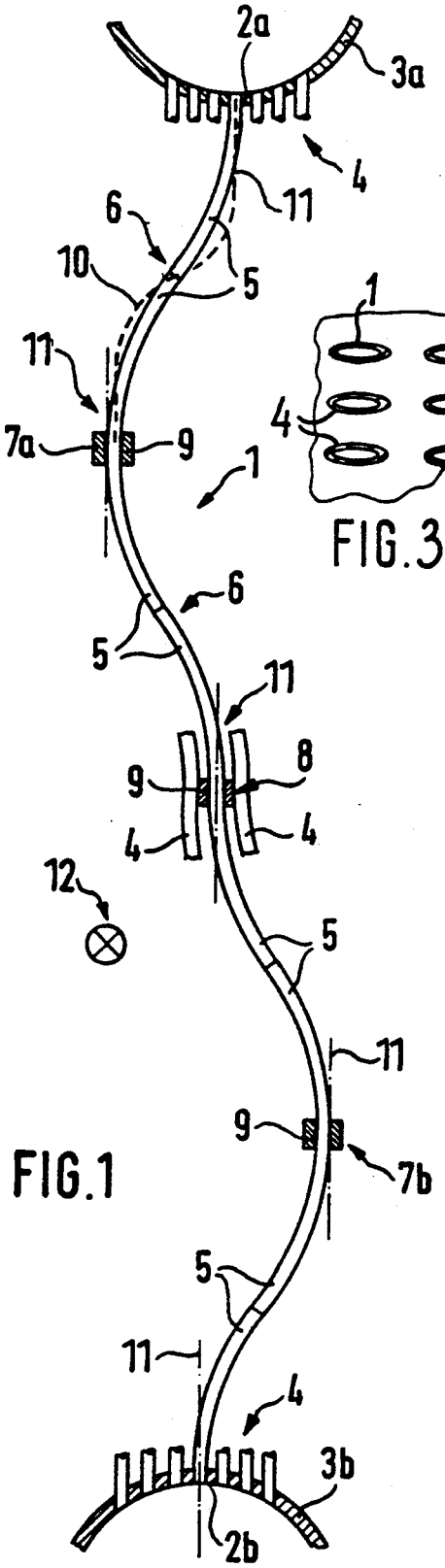
FIG. 1 diagrammatically illustrates in side view one complete heat exchange tube of a tube matrix of a heat exchanger and several additional tubes broken away.
Figure 3:
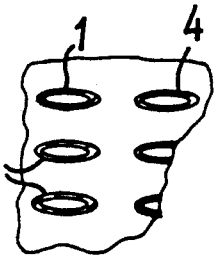
FIG. 3 is a sectional view taken along line 3—3 in FIG. 2 showing several heat exchange tubes of a portion of the tube matrix.

The tube 1 shown in FIGS. 1 and 2 is a complete tube and the other tubes of the matrix extend parallel thereto in rows and columns. The other tubes are designated by numeral 4 and any portions thereof are shown in FIG. 1. The tubes are all identical and uniformly spaced in the tube matrix. The fluid which flows through the tubes is heated by a fluid flowing in cross flow around the tubes in the direction of arrow 12. The fluid in tubes 1, 4 is heated in conventional manner in this way.

The tube 1 is preferably made in one piece and is preferred as shown in FIGS. 1 and 2 and essentially consists of eight curved segments 5 of the same length, which merge together at inflection points 6. Thus, the curved segments 5 represent different curved regions of the integral tube 1 and rather than connecting a number of curved segments 5 together, they are formed by bending the curved segments 5 in the single tube 1. The curved segments 5 alternate in curvature (to the left and the right in FIG. 1) to form a serpentine or undulating contour which is superimposed on a substantially S-shaped outline.

Tube 1 has two opposed peaks at the points of maximum offset at *7a* and *7b*. Between points *7a* and *7b* is an intermediate point 8 which is equally spaced from points *7a*, *7b*. In the regions between the maximum offset points *7a* and *7b* and the intermediate point 8 are arranged two curved segments 5 in each region, such that the central point of the curve on the alternating sides of tube 1 lie in such a way that a left and right alternating curvature is present. In all, four curved segments 5 lie between the maximum offset points *7a* and *7b*. The segments 5 are substantially equal in length and the points of inflection between the sections in each region is midway between successive spacers 9 which maintain the spacing between adjacent tubes.

The tangents 11 to the tube at the maximum offset points *7a*, *7b*, and at intermediate point 8 are parallel. Further, at points *7a*, *7b*, and 8, spacers 9 are provided. Tangents 11 to the tubes at the securing points *2a*, *2b* are also parallel to the aforesaid tangents as seen in FIGS. 1 and 2 the pairs of segments 5 between respective successive securing points *2a*, *2b* and spaces 9 are free and unsupported.

Curved segments 5 can have constant radii of curvature, in which case they are circular segments, or the curved segments may have a sinusoidal shape.

During operation, the heat exchanger is subjected to thermal expansion while at the same time ducts *3a*, *3b*, and spacers 9 are rigidly secured in place. At such time, a deformation of the tube 1 is produced as shown by the dotted line 10 in FIG. 1 which thus allows a thermal expansion of the tube without a total change in shape of the heat exchanger. With such a thermally conditioned deformation of curved segments 5 of tube 1, the adjacent tubes come together most closely at the free inflection points 6, i.e. those which are not engaged by the fixed spacers 9. The spacers 9 at points *7a*, *7b*, 8, fixedly hold the tubes and maintain the spacing therebetween. In order to keep a minimal distance between adjacent tubes 1, 4 for the flow of fluid 12 therearound under all operating conditions, the radius of curvature of curved segments 5 and the amplitude of the sinusoidal curved segment are established such that with maximum expansion due to temperature, a minimum spacing is produced which provides a minimally permissible flow cross section between adjacent tubes 1, 4. For example, for a tube thickness of tubes 1, 4 of 1.6 mm and a temperature difference between the hot and cold state of the tubes of 100° K, the radius of curvature of segments 5 is approximately 3 to 4 cm. and the length of the curved segment is 2.5 cm.

As seen in FOG. 3, the tubes are substantially elliptical in cross section and the flow of fluid 12 is parallel to the direction of the major axis of the elliptical section. The spacers 9 are disposed at uniformly spaced locations and keep the tubes at a defined spacing both with respect to the direction of the major axis of the tubes as well as the minor axis of the tubes.

As evident in FIGS. 1 and 2, the tubes are curved in the plane passing through the minor axis of the elliptical cross section. The shape of the tubes is obtained by bending the curved portions around the major axis of the elliptical cross section.

Although the invention has been described in relation to specific embodiments thereof, it will become apparent to those skilled in the art that numerous modifications and variations can be made within the scope and spirit of the invention as defined in the attached claims.

What is claimed is:

1. A tube matrix for a heat exchanger having two spaced ducts to which the tube matrix is connected for conveying a fluid from one duct to the other, said tube matrix comprising at least one row of spaced heat exchange tubes, each of said tubes having first and second ends at which the tubes are respectively fixedly secured to the two ducts so that said row of tubes lies in a common plane, each said tube being bent to form a generally S-shape in said plane, each said tube having two peaks with points of maximum offset and an intermediate point between said peaks, and successive spacer means at each said point of maximum offset and at said intermediate point for keeping adjacent tubes spaced from one another and fixedly secured at said points, each said tube including respective contiguous sections between said spacer means at said two points of maximum offset and said first and second tube ends, each said section being free and unsupported between respective spacer means and including two bent portions of opposite but the same curvature, said two bent portions of each contiguous section of the tube being substantially equal in length, and defining a point of inflection midway of said contiguous section, each said tube having tangents at said first and second ends and at said points, said tangents extending substantially parallel to one another.

2. A tube matrix as claimed in claim 1 wherein the radius of curvature of each bent portion is between 1 and 2 times the length of said portion.

3. A tube matrix as claimed in claim 1 wherein said bent potions are of sinusoidal curvature.

4. A tube matrix as claimed in claim 1 wherein each tube has an elliptical cross-section with a major and a minor axis, said tube being arranged in said common plane of said row passing through the minor axis of the tube.

5. A tube matrix as claimed in claim 1 wherein said intermediate point is midway between said peaks.

6. A tube matrix as claimed in claim 2 wherein the two bent portions of each contiguous section form one half of a sine wave.

7. A tube matrix as claimed in claim 1, wherein said bent portions of each section have constant radii of curvature.

8. A tube matrix as claimed in claim 1, wherein each tube has eight segments consisting of two segments between each end of the tube and the respective spacer means at said peaks, and two segments between each of the spacer means at said peaks and the spacer means at said intermediate point.

9. A tube matrix as claimed in claim 1, wherein each tube is an integral one piece member, each said section being formed by bending the tube.

10. A tube matrix as claimed in claim 9, wherein each tube has an elliptical cross seciton, the bent portion of each said section being formed by bending the tube around the major axis of the elliptical cross section.

11. A tube matrix as claimed in claim 1, wherein said peaks of each tube are disposed on opposite sides of a plane passing through the ends of said tube.

* * * * *